United States Patent [19]

Takahashi et al.

[11] Patent Number: 4,890,476

[45] Date of Patent: Jan. 2, 1990

[54] PRECISION PLATE BENDING MACHINE HAVING A PLAY REMOVING DEVICE

[75] Inventors: Hideaki Takahashi, Atsugi; Takashi Wakahara, Hatano; Yasuhiro Harashima, Atsugi, all of Japan

[73] Assignee: Amada Company, Limited, Japan

[21] Appl. No.: 180,692

[22] Filed: Apr. 8, 1988

Related U.S. Application Data

[63] Continuation of Ser. No. 37,145, Apr. 10, 1987, abandoned.

[30] Foreign Application Priority Data

Apr. 11, 1986 [JP] Japan ..... 61-082372
Apr. 14, 1986 [JP] Japan ..... 61-054662[U]

[51] Int. Cl.[4] ..... B21D 37/12

[52] U.S. Cl. ..... 72/456; 72/453.09; 72/452; 100/214; 100/282; 267/130

[58] Field of Search ..... 72/455, 456, 453.09, 72/338, 452, 445, 465; 100/214, 282, 260, 261; 267/130

[56] References Cited

U.S. PATENT DOCUMENTS

| | | | |
|---|---|---|---|
| 2,225,145 | 12/1940 | Baumbach | 72/456 |
| 3,373,596 | 3/1968 | Moeller et al. | 100/257 |
| 3,408,849 | 11/1968 | Jetschmann et al. | 72/456 |
| 3,427,856 | 2/1969 | Asari | 72/453.13 |
| 3,777,543 | 12/1973 | Kokkola et al. | 72/455 |
| 4,048,841 | 9/1977 | Kent | 72/455 |
| 4,377,084 | 3/1983 | Kaminski | 267/130 |
| 4,550,588 | 11/1985 | Abe et al. | 72/456 |
| 4,677,908 | 7/1987 | Imanishi et al. | 100/257 |

FOREIGN PATENT DOCUMENTS

| | | | |
|---|---|---|---|
| 2424783 | 12/1975 | Fed. Rep. of Germany | 100/257 |
| 47-33111 | 8/1972 | Japan | 100/257 |
| 0092125 | 5/1984 | Japan | 72/456 |
| 0152399 | 8/1985 | Japan | 100/214 |

*Primary Examiner*—David Jones
*Attorney, Agent, or Firm*—Wigman & Cohen

[57] ABSTRACT

A plate bending machine for performing precise bending operations includes a machine pedestal having two opposite side sections, a guide member provided at each side section of the machine pedestal, and a vertically movable guide post supported by the guide members. A lower bending tool is supported by the machine pedestal and an upper table has two side sections, each supported by the guide posts. An upper bending tool is supported by the upper table and is adapted to move vertically with the upper table to operate in cooperation with the lower bending tool. An eccentric shaft is supported in a freely rotatable manner on the machine pedestal and has an eccentric section with which the guide post is engaged at its lower section, wherein there is play between the guidepost and the eccentric section. A play removing device is mounted on the machine pedestal, for removing the play between the guide post and the eccentric section.

3 Claims, 6 Drawing Sheets

PRECISION PLATE BENDING MACHINE HAVING A PLAY REMOVING DEVICE

This is a continuation of co-pending application Ser. No. 037,145, filed on Apr. 10, 1987, now abandoned.

BACKGROUND OF THE INVENTION

1. Field of the Invention

The present invention relates to a device which performs a bending process on a plate workpiece, and, specifically, to a plate bending machine provided with a control mechanism to precisely position upper and lower bending tools by eliminating play or backlash between them before abutment.

2. Description of the Prior Art

A press brake is commonly known as a device which performs a bending process on a plate workpiece. In a conventional press brake, an upper table (ram) with a vertically operating format which supports an upper bending tool in a press brake, the upper table descends, and when it performs the bending operation on the workpiece the play in each of the connected parts, for example, the play between the connecting rod and the crankshaft, or the play between the screw and the ram must be taken up, so a cylinder or spring is used as a counterbalance.

However, when a cylinder is used, a motive source is required, and when a spring is used, a long spring is necessary in relation to the spring constant to cover the entire stroke, and in the case where the upper frame positioning is carried out in the vicinity of the bottom dead point there occurs the problem that positioning with good precision is not possible.

Further, in order to adjust the height of the upper table to accommodate the change in height of the top and bottom bending tools and to accommodate the change in thickness of the workpiece, the left and right side sections of the upper table are mounted in a manner to freely adjust the vertical position through the medium of a bushing or the like in the guide posts.

Accordingly, the problem arises that the positional control of the upper bending tool relative to the lower bending tool cannot be performed with high precision because of the play.

OBJECTS OF THE INVENTION

An object of the present invention is to provide, with due consideration to the drawbacks of such conventional devices, a novel plate bending device wherein a resilient member is provided on the machine pedestal or the upper section of the guide member to contact an upper table before an upper bending tool contacts the workpiece on a lower bending tool during the time of descent of the upper table, and wherein it is possible to remove the play in the connected members in the vicinity of the bottom dead point, both compactly and reliably.

Another object of the present invention is to provide a novel plate bending machine wherein play is eliminated by the provision of a backlash elimination device between the guide posts and the upper table, and the precision of the bending process is improved.

In order to accomplish these objects, according to a first feature of the present invention, a pair of guide posts are vertically movably supported on guide members provided on both side sections of a machine pedestal which supports a lower bending tool. Supported on the guide posts are both side sections of an upper table which supports a top bending tool which works in cooperation with the lower bending tool. The lower section of each guide post is linkingly provided on an eccentric section of an eccentric shaft which is supported in a freely rotating manner on the machine pedestal, and a resilient body is mounted on the upper section of a guide member which guides the machine pedestal or the guide post to come into contact with the upper table prior to contacting a plate workpiece on the lower bending tool contacts as the result of the descent of the upper table.

According to the second feature of the present invention, a pair of guide posts are vertically movably supported on guide members provided on both side sections of a machine pedestal which supports a lower bending tool, and an upper table which supports a top bending tool which works in cooperation with the lower bending tool has its both side sections threaded with a screw member supported in a freely rotatable manner on the guide posts. A hydraulic cylinder is provided between the guide post and the upper table to eliminate the backlash in the screw section, and the lower section of each guide post is connected to an eccentric portion of an eccentric shaft supported in a freely rotatable manner on the machine pedestal.

BRIEF DESCRIPTION OF THE DRAWINGS

These and other objects, features, and advantages of the present invention will become more apparent from the following description of a preferred embodiment taken in conjunction with the accompanying drawings, in which.

DETAILED DESCRIPTION OF THE PREFERRED EMBODIMENTS

Figure 1:
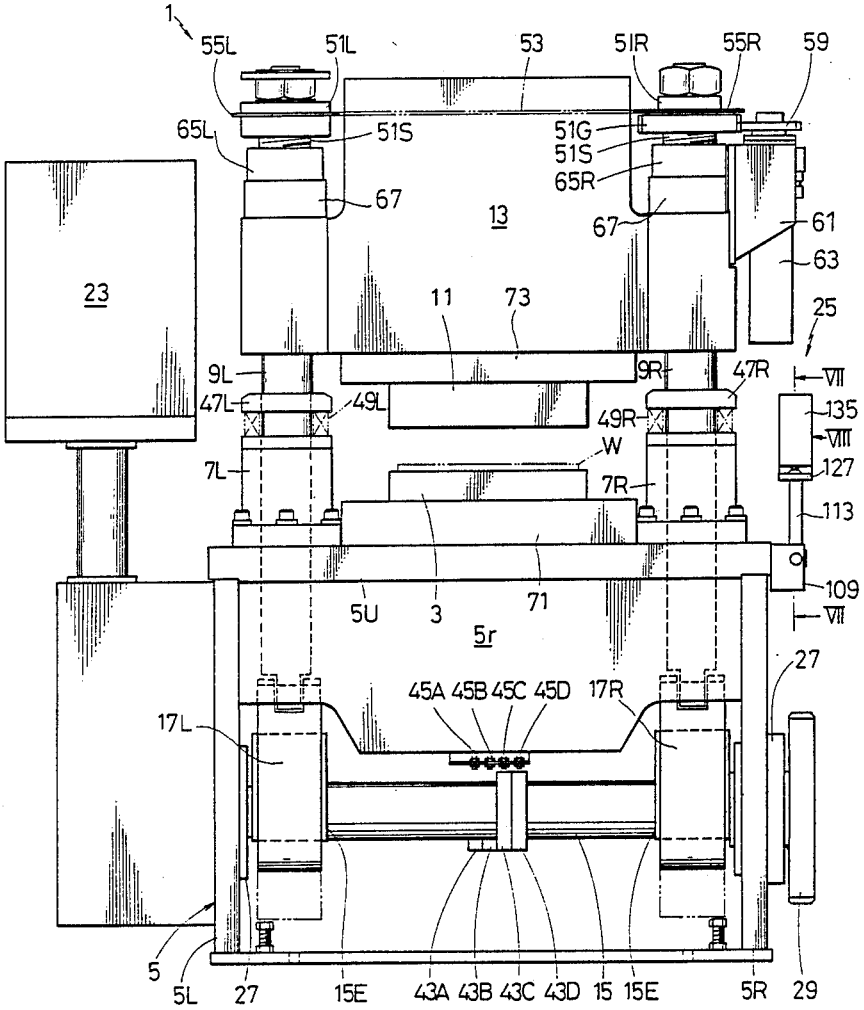
FIG. 1 is a front elevation of a plate bending device.

An embodiment of the present invention is now described with reference to the drawings.

Now referring to FIG. 1 to FIG. 4, a bending machine 1 for performing a bending operation on a plate workpiece W is provided with a box-shaped machine pedestal 5 which supports a lower bending tool 3. A pair of guide posts 9R and 9L on a pair of guide members 7R and 7L provided on the left and right sides of the machine pedestal 5 are supported for vertical movement in the vertical direction. The left and right side sections of an upper table (ram) 13 which supports an upper bending tool 11 which performs the bending process on the workpiece W in cooperation with the lower bending tool 3 are supported on the upper sections of the left and right guide posts 9R and 9L. The lower sections of the guide posts 9R and 9L are suitably connected through a pair of connecting rods 17R and 17L to an eccentric section 15E of an eccentric shaft (crankshaft) 15 which is supported in a freely rotatable manner on the machine pedestal 5.

By means of the above configuration, the upper table 13 moves vertically through the guide posts 9R, 9L from the suitable rotation of the eccentric shaft 15. Accordingly, after the workpiece W is positioned on the lower bending tool 3, the eccentric shaft 15 is rotated and the upper table 13 descends, and the bending process is performed on the workpiece W as a result of the engagement of the upper bending tool 11 with the lower bending tool 3.

When the bending of the workpiece W is performed as outlined above, in order to detect the positional status of the workpiece W, as will be later explained, a reference line reading device 19 which optically detects reference lines such as marking lines which are drawn on the workpiece W is mounted on the rear surface of the upper table 13. In addition, a back gauge device 21 is provided in a position in the rear direction (the right direction in FIG. 2) of the lower bending tool 3 to carry out accurate positioning of the workpiece W based on the results of the reading of the reference line reading device 19. Furthermore, in the bending machine 1, a control panel 23, on which are mounted, for example, a display device (omitted from the drawings) such as a CRT device and a numerical control device (hereinafter referred to as an NC device), is provided to control each working section of the bending machine 1, and a thickness detection device 25 is provided which detects the plate thickness of the workpiece W being processed and outputs that data to the NC device.

In more detail, the machine pedestal 5 is formed in an approximately box shape and comprises a pair of left and right side plates 5R and 5L and a horizontal upper plate 5U which is supported at both the left and right side sections by the front side upper sections of the side plates 5R, 5L. A reinforcing plate 5r is installed on the front and rear sections of the bottom surface of the upper plate 5U.

The eccentric shaft 15 is positioned below the upper plate 5U of the machine pedestal 5. Both the left and right edge sections of the shaft 15 are supported in a freely rotatable manner on the side plates 5R and 5L through a shaft support device 27. A driven gear 29 is integrally mounted on one edge section of the eccentric shaft 15 by means of key and nut. A drive gear 31 engages the driven gear 29. The drive gear 31 is mounted on the output shaft of a servomotor 33 mounted on the side plate 5R. Accordingly, by the rotation and halting in a suitable manner of the servomotor 33 under the control of the NC device, it is possible to control such factors as the descent velocity and the halt position of the upper table 13.

Figure 5:
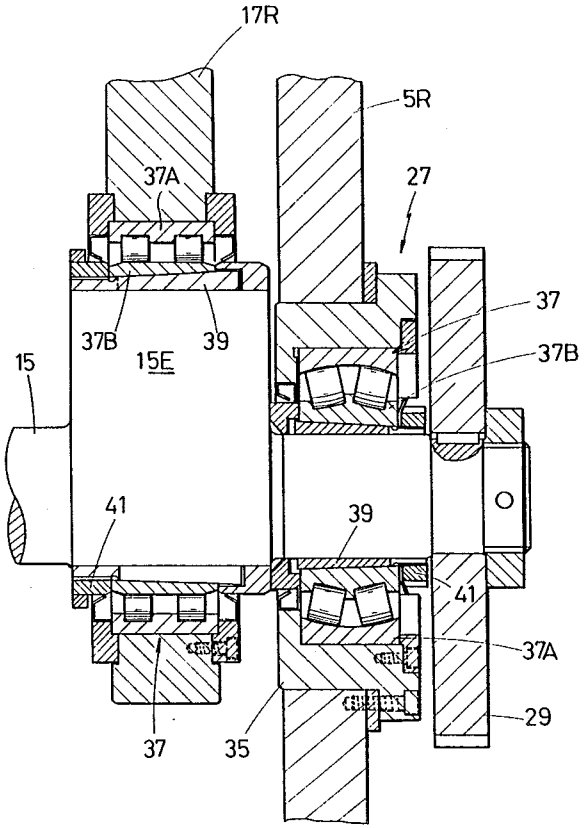
FIG. 5 is an expanded sectional drawing viewing along the line V—V in FIG. 2.

The shaft support device 27 has a special construction in order to eliminate minute gaps in the shaft support section of the eccentric shaft 15. Specifically, as shown in FIG. 5, a ring-shaped shaft support holder 35 is integrally mounted on one 5R of the side plates by means of a bolt or the like. An outer ring 37A of the bearing 37 is engaged in intimate contact by the ring-shaped shaft support holder 35.

The inner circumferential surface of an inner ring 37B in the bearing 37 is formed as a tapered orifice which corresponds to a tapered section of the outer circumferential surface of a bushing 39 in intimate contact with the eccentric shaft 15. A threaded section is formed in one end section of the bushing 39. A nut member 41 which contacts the end surface of the inner ring 37B is screwed onto this threaded section. A detailed drawing has been omitted, but a slot extending over a suitable length is formed in the axial direction from the other end of the bushing 39, so that the bushing 39 radially expands and contracts at the end.

In the above configuration, by tightening the nut member 41, the inner ring 37B of the bearing 37 and the bushing 39 are placed in a status of intimate contact, and by action of the tapered section there is intimate contact between the bushing 39 and the eccentric shaft 15. Accordingly, the minute gaps in the shaft support section of the eccentric shaft 15 are eliminated.

Further, the device for eliminating minute gaps is constructed in the same manner with reference to the shaft support section of the eccentric shaft 15 relative to the other side plate 5L, the connecting section between the connecting rods 17R and 17L and the eccentric section 15E of the eccentric shaft 15, and the connecting section between the connecting rods 17R, 17L and the guide posts 9R, 9L, so that the similar numbers are attached for the construction members having the same functions, and further explanation has been omitted.

As can be understood from the above explanation, the minute gaps in the rotating section of the shaft support section and the like of the eccentric shaft 15 are eliminated, so that in this embodiment of the present invention when the eccentric shaft 15 is suitably rotated and halted such that the position of the upper table 13 is controlled, position control with good precision is possible.

In order to detect the top dead point and the bottom dead point of the eccentric shaft 15, as shown in FIG. 1, two pairs of dogs 43A and 43B, and 43C and 43D are mounted on the eccentric shaft 15. Two pairs of sensors 45A, 45B and 45C, 45D are mounted on the machine pedestal 5, corresponding to the dogs 43A and 43B. Part of the pair of dogs 43A and 43B overlaps slightly at the position which indicates the bottom dead point of the eccentric shaft 15, and in addition, the other pair of dogs 43C and 43D overlap slightly at the position which indicates the top dead point. Accordingly, the sensors 45A, 45B corresponding to the dogs 43A, 43B together in the sensing action function halt the eccentric shaft 15, so that the halt is made at the bottom dead point. Conversely, the sensors 45C, 45D corresponding to the other dogs 43C, 43D together in the sensing action function halt the eccentric shaft 15, so that the halt is made at the top dead point. Specifically, in this embodiment of the present invention, the halt at the top dead point and bottom dead point of the eccentric shaft 15 is carried out with good precision.

Again referring to FIG. 1 to FIG. 4, the guide members 7R, 7L which vertically guide the guide posts 9R, 9L are formed in a cylindrical shape. The guide members 7R, 7L are positioned to have an axis substantially in alignment with the vertical face running through the axis of the eccentric shaft 15. The guide members 7R, 7L and the guide posts 9R, 9L are fitted so that there is no play between them. At the top of the guide members 7R, 7L, a pair of ring members 47R, 47L are provided with free vertical movement so as to contact the upper table 13 supported on the guide posts 9R, 9L.

The ring members 47R, 47L are provided so that they contact the upper table 13 prior to the engagement of the upper bending tool 11 and the lower bending tool 3 from the descent of the upper table 13, and the ring members 47R, 47L are always energized in the upward direction by means of a pair of resilient members 49R, 49L which are resiliently installed between the guide members 7R, 7L. The resilient members 49R, 49L have sufficient strength to press up the total weight of the upper table 13 and the guide posts 9R, 9L and the like.

In the above configuration, when the upper table 13 descends to perform the bending operation on the workpiece W, first the upper table 13 contacts the ring member 47, and is inclined to be pressed relatively upward by the resilient members 49R, 49L. The play in the connecting sections is oriented in one direction, and in the case where the positioning of the upper table is carried out close to the bottom dead point, positioning with good precision can be obtained.

In order to adjust the height of the upper table 13 to correspond to a change in the height of the upper and lower bending tools 11, 3 and to a change in the thickness of the workpiece W, both the left and right sides of the upper table 13 are mounted on the guide posts 9R, 9L freely adjustingly in the vertical direction.

Specifically, on the upper ends of the guide posts 9R, 9L a pair of cylindrical rotating bodies 51R, 51L, each provided with a threaded section 51S on the bottom side, are supported so that they are capable only of free rotation. A pair of chain sprockets 55R, 55L are integrally mounted on the rotating bodies 51R, 51L in mutually synchronous rotation. An endless chain 53 which runs around the chain sprockets 55R, 55L is stretched tight by means of a tension sprocket 57 (see FIG. 4) which is suitably mounted on the upper table 13. A driven gear 51G is integrally provided in a suitable manner on one of the rotating bodies 51R. A drive gear 59 engages the driven gear 51G. The drive gear 59 is mounted on the output shaft of an adjusting motor 63 which is supported on the upper table 13 through a bracket 61. A pair of nut members 65R, 65L installed on each side section of the upper table 13 are screwed onto the threaded section 51S of the respective rotating bodies 51R, 51L.

Accordingly, when the adjusting motor 63 is driven in a suitably rotating manner, the chain sprockets 55R, 55L are rotated synchronously through the chain 53. Therefore, the upper table 13 is adjustably positioned in the vertical direction in relation to the guide posts 9R, 9L through the synchronous rotation imposed on the rotating bodies 51R, 51L.

In order to remove the backlash between the threaded section 51S of the rotating bodies 51R, 51L and the nut members 65R, 65L and obtain good vertical position adjustment precision for the upepr table 13, a backlash removal device is provided between the guide posts 9R, 9L and the upper table 13.

Figure 6:
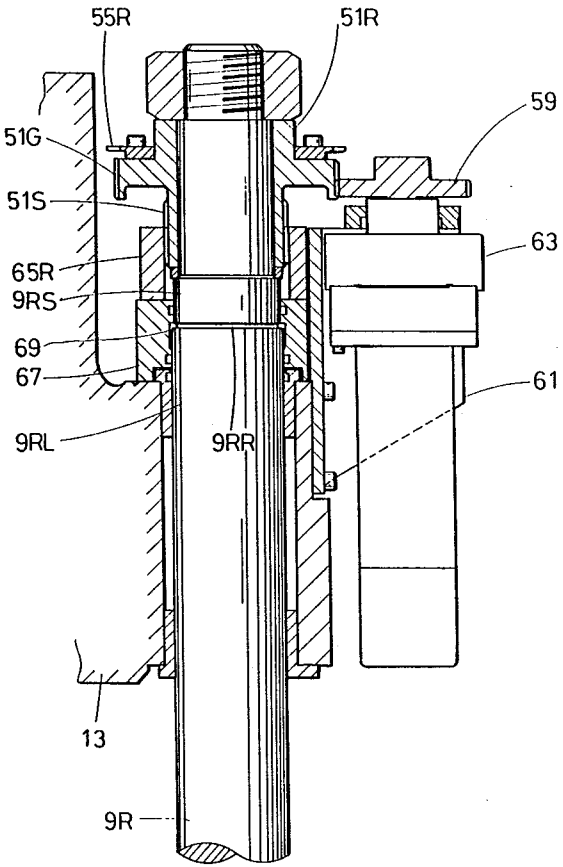
FIG. 6 is an expanded sectional drawing viewing along the line VI—VI in FIG. 2.

Specifically, as shown in FIG. 6, a stepped section 9RR having a larger diameter section 9RL and a smaller diameter section 9RS is formed on the top of the guidepost 9R. A cylindrical member 67, which is provided around the stepped section 9RR, is fitted over the smaller diameter section 9RS and the larger diameter section 9RL. A hydraulic chamber 69 is formed in the section corresponding to the stepped section 9RR. The cylinder member 67 is integrally maintained in the space between the nut member 65R and the upper table 13.

In the above configuration, when an operating fluid is fed into the hydraulic chamber 69, the fluid pressure acts upon the stepped section 9RR of the guide post 9R and upon the inner surface of the cylinder member 67. Accordingly, because the upper pressurized area of the cylinder member 67 is larger than its lower pressurized area in proportion to the difference between the larger diameter section 9RL and the smaller diameter section 9RS of the guidepost 9R, the cylinder member 67 moves to the upper side relative to the guide post 9R, and the nut member 65R moves in the upper direction. Therefore, the backlash between the nut member 65R and the threaded section 51S of the rotation body 51R is eliminated.

As has already been explained, when the lower bending tool 3 and the upper bending tool 11 engage to perform the bending operation on the workpiece W, the process is performed in the state in which the play in the connecting section is eliminated and the backlash in the threaded section is eliminated. It is therefore possible to control the position of the upper bending tool 11 relative to the lower bending tool 3 with high precision, and a highly precise bending process is obtained.

The lower bending tool 3 is positioned between the guide members 7R, 7L, almost in agreement with the vertical surface running through the centerline of the guide members 7R, 7L, and is supported on the machine pedestal 5 through a lower bending tool holder 71, so that no bending is produced in the front and rear directions of the guide posts 9R, 9L, from drag and reaction when the workpiece W is being subjected to the bending process. In addition, the upper bending tool 11 is supported on the lower section of the upper table 13 through an upper bending tool holder 73 and is positioned vertically with respect to the lower bending tool 3.

Accordingly, when the bending process is performed on the workpiece W by means of the upper and lower bending tools 11, 3, the guide posts 9R, 9L are subjected to the vertical reaction, so that the guide posts 9R, 9L are not bent in the front-to-rear direction. Therefore, the alignment of the upper and lower bending tools 11, 3 is carried out accurately and a bending operation is obtained with good precision.

Figure 3:
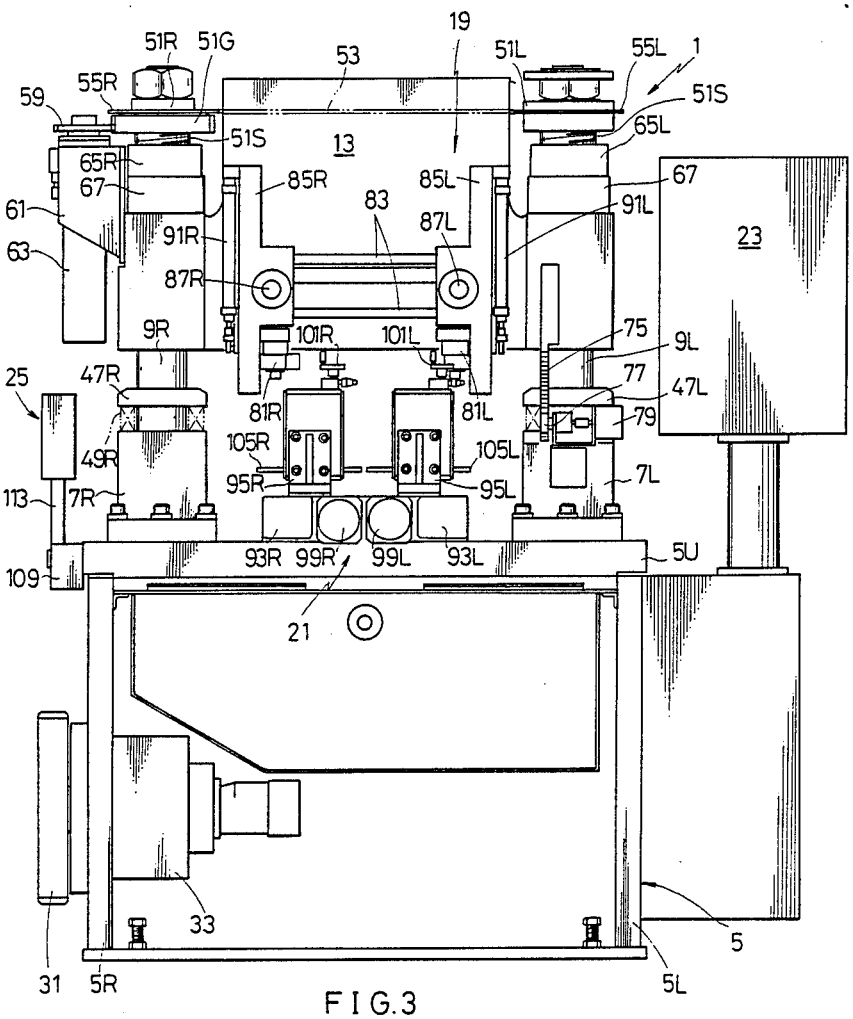
FIG. 3 is a rear elevation of the same plate bending device.

As shown in FIG. 3, a rack 75 which extends in the vertical direction is installed on the upper table 13 in order to detect the descent position and the velocity of the upper table 13 when, as previously outlined, the upper table 13 descends and the bending operation is performed on the workpiece W. In addition, a rotary pulse encoder 79 provided with a pinion 77 which engages the rack 75 is mounted on one section of the machine pedestal 5. Accordingly, when the upper table 13 descends from the top dead point, the number of pulses output from the pulse encoder 79 is counted and the descent velocity and position can be detected by the use of suitable calculation process.

Figure 2:
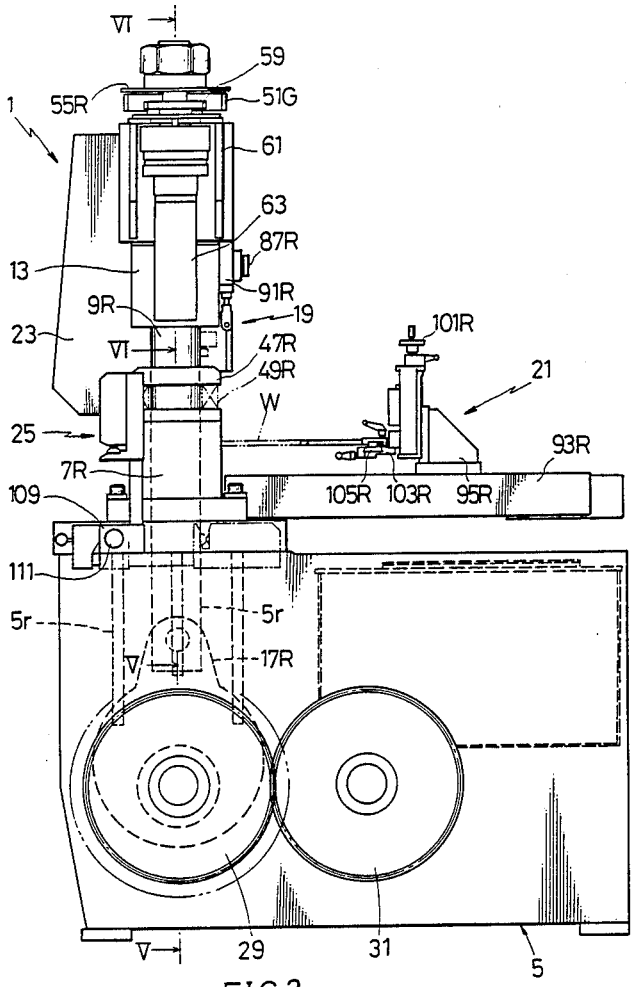
FIG. 2 is a right side elevation of the same plate bending device.
Figure 4:
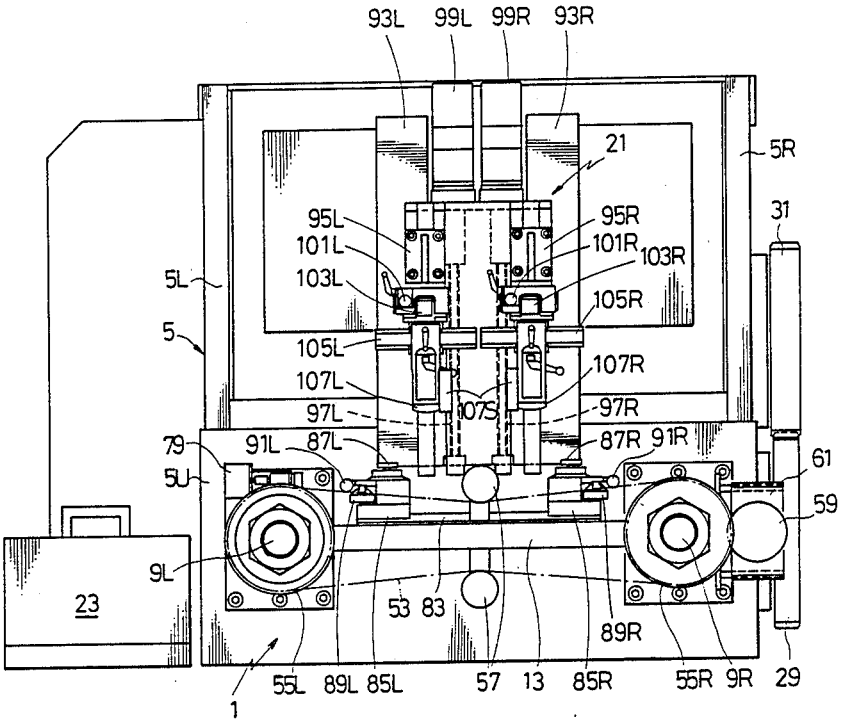
FIG. 4 is a plan view of the same plate bending device.

Now referring to FIG. 2 to FIG. 4, the reference line reading device 19 optically detects reference lines inscribed on the workpiece W preceding the bending process on the workpiece W. In this embodiment of the present invention, a pair of sensors 81R, 81L are provided on the right and left side sections respectively of the rear surface of the upper table 13. The sensors 81R, 81L are provided with a light beam emission section which emits a light beam such as a laser beam or visible light beam onto the upper surface of the workpiece W. The sensors 81R, 81L are also provided with a detection section for detecting the presence and strength of reflected light. Thus, the position of the bending process such as an inscribed line is detected. The detection section of the sensors 81R, 81L can be, for example, an image sensor or one of various types of optical sensors.

The data detected by the sensors 81R, 81L is used to control the position of the back gauge 21.

Specifically, the reference line reading device 19 is provided with a pair of supporting members 85R, 85L supported on a guide rail 83 which is provided horizontally on the rear surface of the upper table 13. The position of the supporting members 85R, 85L is freely adjustable in the lateral direction. On the supporting members 85R, 85L, a securing bolt is provided which can secure the supporting members 85R, 85L to the guide rail 83. A pair of tightening knobs 87R, 87L are provided on the end sections of the securing bolt. In addition, the supporting members 85R, 85L are provided with a pair of elevating members 89R, 89L which are vertically movable, and a pair of elevating cylinders 91R, 91L are provided for elevating and lowering the elevating members 89R, 89L. The sensors 81R, 81L are mounted on the lower section of the elevating members 89R, 89L.

As a result of this configuration, the supporting members 85R, 85L can be suitably positioned along the guide rail 83, and can accommodate any width of workpiece W. In addition, the elevating members 89R, 89L can be moved to descend so that the location of the reference lines which have been inscribed on the workpiece W ahead of time can be detected when the workpiece W is adjacent to the sensors 81R, 81L, and to raise so as to avoid interference between the workpiece W and the sensors 81R, 81L by ascending.

The back gauge device 21 for positioning the workpiece W, is provided with a pair of guide bases 93R, 93L supported on the machine pedestal 5 and extending in the front-to-back direction as indicated in FIG. 2 to FIG. 4. A pair of carriages 95R, 95L are supported with free front-to-rear mobility as transfer members on the guide bases 93R, 93L. The guide bases 93R, 93L are provided with a pair of typical ball screws 97R, 97L screwed in a nut member (omitted from the drawings) on the carriages 95R, 95L, and with a pair of servomotors 99R, 99L which individually rotate the ball screws 97R, 97L.

A pair of operating wheels 101R, 101L are provided on the carriage 95R, 95L respectively, and a pair of elevation members 103R, 103L are provided whose vertical position is freely adjustable by the rotary operation of the operating wheels 101R, 101L. On the lower section of the elevating members 103R, 103L, a dovetail groove is formed in the left-to-right direction which is transverse to the direction of movement of the carriages 95R, 95L. A pair of gauge holders 105R, 105L are supported in a freely securable manner in the dovetail groove by means of normal tightening means and are capable of positional adjustment in the left-to-right direction to extend horizontally in the left-to-right direction. A pair of abutment positioning members 107R, 107L, which the workpiece W is abutted against, are positionally adjusted in the left-to-right direction and supported in a freely securable manner in the gauge holders 105R, 105L. A sensor 107S for detecting the contact of the workpiece W is mounted on the opposing faces of each contact positioning member 107.

From this configuration, it is possible to individually adjust the positions of the carriages 95R, 95L in the front-to-rear direction by the individual driving of each serve motor 99R, 99L. Accordingly, they can be applied in the case where the rear edge of the workpiece W is inclined in the left-to-right direction, and, for example, even in the case where the processing position of the workpiece W is inclined, compensation is possible by moving one of the carriages in the front-to-rear direction.

Specifically, in this embodiment of the present invention, the workpiece W is positioned while maintaining the status where the rear edge of the workpiece W contacts the left-to-right contact positioning members 107R, 107L which are previously positioned so that the scheduled process position of the workpiece W comes on a process line determined by the upper and lower bending tools 11, 3. Then, an inscribed line or the like on the workpiece W is detected by the left and right sensors 81R, 81L on the reference line reading device 19. When the processing position of the workpiece W is inclined with respect to the processing position of the upper and lower bending tools 11, 3, one of the servomotors 99R, 99L is driven to conform to the magnitude of that inclination to compensate for the position of one of the contact positioning members 107R, 107L, whereby the processing position of the workpiece W can be modified in parallel to the processing position of the bending tools and accurate positioning becomes possible.

Figures 7, 8:
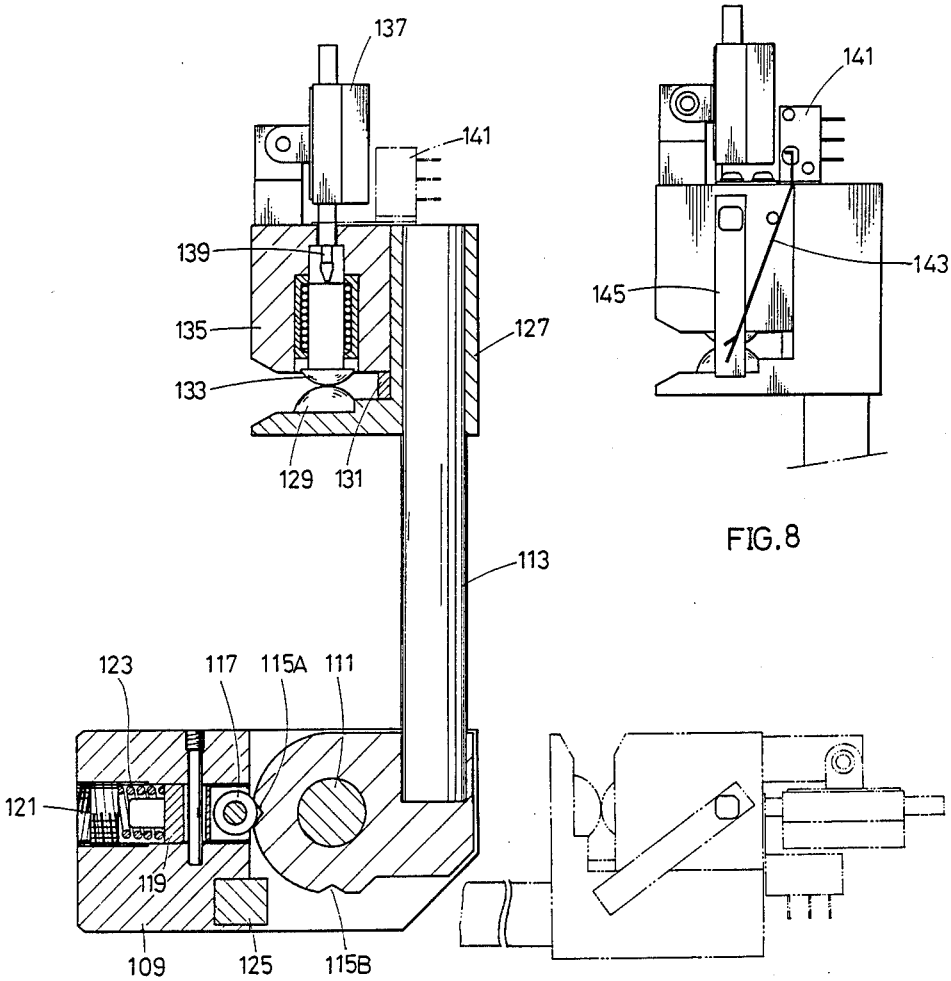
FIG. 7 Is an expanded sectional drawing viewing along the line VII—VII in FIG. 1.
FIG. 8 is an expanded sectional drawing viewed in the direction of the arrow VIII in FIG. 1.

The thickness detection device 25 which detects the thickness of the workpiece W is, as indicated in FIG. 1, mounted through a mounting block 109 which is mounted on the side surface of the upper plate 5U on the machine pedestal 5. Now referring to FIG. 7 and FIG. 8, as shown in detail in these drawings, a column 113 is supported in a freely collapsible manner through a drive shaft 111 on the mounting block 109. A plurality pair of concave sections 115A, 115B are formed in an arc-shaped section formed at the base of the column 113. On the other hand, slidably mounted on the mounting block 109 is a plunger 119 which is provided with a roller 117 which can freely engage with or disengage from the concave sections 115A, 115B. The plunger 119 is always biased toward the base side of the column 113 by the operation of a spring 123 which is installed between the plunger 119 and a threaded member 121 which is screwed into the mounting block 109. In addition, a stopper 125 is provided in the mounting block 109.

A base block 127, whose cross section is in the shape of a reversed letter L, is mounted on the tip section of the column 113. Integrally mounted on a protruding section of the base block 127 are a semicylindrical supporting element 129 which supports the workpiece W and an abutment block 131 against which the workpiece W is abutted. Further, integrally provided on the upper base block 127 is a holder block 135 which is separately opposed to the protruding section of the base block 127. Axially movably supported on the holder block 135 is a contact element 133 which is provided at one end with a hemispherical contact section opposed to the supporting element. Mounted on the holder block 135 is a measurement apparatus 137, such as a dial gauge or differential transformer to detect the amount of movement with a spindle 139 in contact with the other end of the contact element 133. The measurement apparatus 137 is constructed so that it outputs to the NC device the data obtained when measuring the plate thickness of the workpiece W. The minimum data from the measurement apparatus 137 is stored in the NC device, so that this minimum value is identified as the thickness of the workpiece W. Based on this thickness data, all the moving parts are suitably controlled.

Mounted on the holder block 135 is a limit switch 141 which detects that the workpiece W is inserted between the supporting element 129 and the contact element 133, and contacts with the contact block 131. Also, a protective plate 145 which protects the active element 143 on the limit switch 141 is supported on the holder block 135.

By means of the above configuration, the column 113 is suitably rotated for the selective engagement of the roller 117 in the concave sections 115A, 115B, the column 113 can be maintained in a vertical status in which the column 113 can be used, or in a horizontal status when the column 113 cannot be used. The column 113 is maintained in the vertical status, the workpiece W is inserted between the supporting element 129 and the contact element 113, and when the contact block 131 is contacted the limit switch 141 is activated and measurement can take place in this status. In the above manner, by the insertion of the workpiece W between the supporting element 129 and the contact element 133, the measurement apparatus 137 detects the thickness of the workpiece W. At this time, then the workpiece is swung vertically with the top of the supporting element 129 as a fulcrum, the contact element 133 moves vertically, and the value measured by the measurement apparatus 137 changes. These measured values are each held for the minimum amount of time, and the thickness of the workpiece W is determined from the minimum value. Then, based on this thickness, the position of the upper table 13 is controlled corresponding to the bending angle, and the necessary action sections are controlled.

As can be understood from the above explanation of the embodiment of the present invention, the play in each of the connected parts can be reliably eliminated by using a resilient body in the vicinity of the bottom dead point, for which no motive source is necessary, and the play can be absorbed compactly and reliably, and the upper bending tool can be positioned with good precision.

In addition, a backlash eliminating device is provided between the guide posts and the upper table. By this means, when the lower bending tool and upper bending tool are engaged and the bending process is performed on the workpiece, the process is performed in the status wherein the play between the connecting sections is eliminated, and the position of the upper bending tool relative to the lower bending tool can be controlled with high precision, so that it is possible to provide improved precision in the bending process.

What is claimed is:

1. A plate bending machine for performing precise bending operations comprising:

a machine pedestal having two opposite side sections;

a pair of guide members provided at each side section of said machine pedestal;

a pair of guide posts vertically movably supported by said guide member;

a lower bending tool supported by said machine pedestal;

an upper table having two side sections each supported by said guide post;

an upper bending tool supported by said upper table and adapted to vertically move with said upper table to operate in cooperation with said lower bending tool;

an eccentric shaft supported in a freely rotatable manner on said machine pedestal and having an eccentric section with which said guide post at its lower section is engaged, wherein there is play between said guide post and said eccentric section; and play removing means mounted on said machine pedestal, for removing the play between said guide post and said eccentric section;

wherein said play removing means further comprises a pair of resilient members, one of each of said resilient members being mounted on one of each of the guide members in a manner such that each of the resilient members surrounds the respective guide member in a horizontal plane.

2. The plate bending machine of claim 1, wherein said play removing means comprises a resilient member which is adapted to come into contact with said upper table before said upper bending tool contacts a workpiece on said lower bending tool.

3. The plate bending device of claim 2, wherein said resilient member is provided on the guide member at an upper section of the guide member.

* * * * *